US005289840A

United States Patent [19]

Anderson

[11] Patent Number: 5,289,840

[45] Date of Patent: Mar. 1, 1994

[54] YARD HYDRANT

[75] Inventor: Stephen J. Anderson, Storm Lake, Iowa

[73] Assignee: Merrill Manufacturing Company, Inc., Storm Lake, Iowa

[21] Appl. No.: 22,442

[22] Filed: Feb. 25, 1993

[51] Int. Cl.[5] ..... E03B 9/04; E03B 9/14; F16K 43/00

[52] U.S. Cl. ..... 137/15; 137/288; 137/292; 137/302; 137/307; 137/315; 251/214

[58] Field of Search ..... 137/15, 272, 288, 292, 137/301, 302, 307, 283, 284, 315; 251/214; 285/328, 332.4

[56] References Cited

U.S. PATENT DOCUMENTS

| | | | |
|---|---|---|---|
| 233,483 | 10/1880 | Dietz | 285/332.4 |
| 313,452 | 3/1885 | Ruppel | 137/302 |
| 353,739 | 12/1886 | Earle | 137/285 |
| 660,832 | 10/1900 | Bell | 285/332.4 |
| 1,265,479 | 5/1918 | Moore | 137/285 |
| 1,776,615 | 9/1930 | Boothman et al. | 285/332.4 |
| 2,649,111 | 8/1953 | Anderson | 137/304 |
| 2,795,440 | 6/1957 | Holycross et al. | 285/332.4 |
| 3,070,116 | 12/1962 | Noland et al. | 137/302 |
| 3,158,170 | 11/1964 | Tubbs | 137/218 |
| 3,162,453 | 12/1964 | Magos et al. | 251/214 |
| 3,244,192 | 4/1966 | Noland | 137/302 |
| 3,257,095 | 6/1966 | Siver | 251/214 |
| 3,407,837 | 10/1968 | Fulton et al. | 137/301 |
| 3,424,189 | 1/1969 | Woodford | 137/302 |
| 3,943,963 | 3/1976 | Papacek | 137/272 |
| 4,372,339 | 2/1983 | Anderson | 137/292 |
| 4,944,488 | 7/1990 | Clayson | 251/214 |

*Primary Examiner*—George L. Walton
*Attorney, Agent, or Firm*—Morton S. Adler

[57] ABSTRACT

A yard hydrant includes a head section with a nozzle, a standpipe and valve housing in traditional hydrant relationship that is constructed and assembled into an integral unit which cannot be disassembled. An operating rod with valve means reciprocates in the standpipe and a valve housing in a well known manner. The rod extends through an enlarged opening formed in the head section for which there is provided a novel two piece gland unit with one piece being a packing gland nut for seal engagement with the operating rod in a well known manner and the other piece being a concentrically larger nut that is removably mounted in said opening in a watertight relationship thereto and in pressing engagement with the packing gland nut. Removal of the gland unit permits the operating rod and any attached components to be quickly and easily withdrawn from the integral unit through the opening in the head section for servicing or repairs.

12 Claims, 2 Drawing Sheets

YARD HYDRANT

BACKGROUND OF THE INVENTION

This invention relates to improvements in yard hydrants and more particularly to an innovative form of construction and assembly not heretofore used.

Yard hydrants have long been used in water distribution systems and while they vary in details of construction for the common purpose of delivering a flow of water from a source of supply to a point of use, they all, in one form or another, include the common and traditional components of a head section, a valve housing for connection to a source of water supply under pressure, a standpipe connected to such section and housing and an operating rod with valve means reciprocating in the standpipe and valve housing to control water flow in a well known manner. Since it is necessary with the yard hydrant from time to time to remove the operating rod and attached valve parts for servicing and repairs, the traditional and currently used method by which past and present hydrant devices provide for such removal is to assemble the standpipe to the head section by threadable connections so that they can be disassembled for removal of internal parts. Since this form of assembly and disassembly has been effective for its intended purpose, it has been and is traditionally used although other changes and developments in the hydrant art have been made as exemplified in U.S. Pat. Nos. 353,739, 1,265,479, 2,649,111, 3,158,170 and 3,943,963.

In the highly competitive hydrant industry that exists today where there is a constant search for lower cost alternatives in hydrant construction and where minor reductions in cost of the finished product can become a formidable and valuable asset when mass production operatings are involved as they are in this field, I have found that the standpipe is one of the main components affecting the cost and selling price of the finished product because of a relatively high fixed cost component required in the cost of pipe having the necessary wall thickness required to accept threading and the necessary cost of threading not only both ends of the pipe but also the threading of the head section and the valve housing. Accordingly, it is one of the principal object of this invention to provide innovations in the construction and assembly of the yard hydrant that make it more simple, facile, economical and practical as compared with other past and present like devices.

More particularly, it is object herein to provide a yard hydrant in which the traditional separable components of a head section with a nozzle, a standpipe and valve housing are formed as an integral unit that cannot be disassembled and in which an opening in the head section portion receives a removable novel two piece packing gland unit that when removed, permits the quick and easy removal of internal parts for servicing and repairs.

SUMMARY

A yard hydrant in which a head section with a nozzle, a valve housing and a standpipe are in traditional hydrant relationship but are constructed and assembled as an integral unit that cannot be disassembled. An opening is provided in a portion of the head section in axial alignment with the stand-pipe so that an operating rod with one end extending upwardly through said opening can be reciprocated by a suitable means in said standpipe relative to the valve housing in a well known manner. The opening has a diameter larger than that of the operating rod and any attached components. A novel two piece packing gland unit is provided with one piece being a packing gland nut for water seal engagement with the operating rod in a well known manner and the other piece being a concentrically larger nut that is removably mounted in said opening in a watertight relationship thereto and in pressing engagement with the packing gland nut. Removal of the gland unit permits the operating rod and any attached component to be easily and quickly withdrawn from the integral unit through the opening in the head section for servicing and repairs.

The foregoing objects and such further objects as may appear herein, or be hereinafter pointed out, together with the advantages of this invention will be more fully discussed and developed in the more detailed description of the accompanying drawings.

DESCRIPTION OF THE PREFERRED EMBODIMENTS

Figure 1:
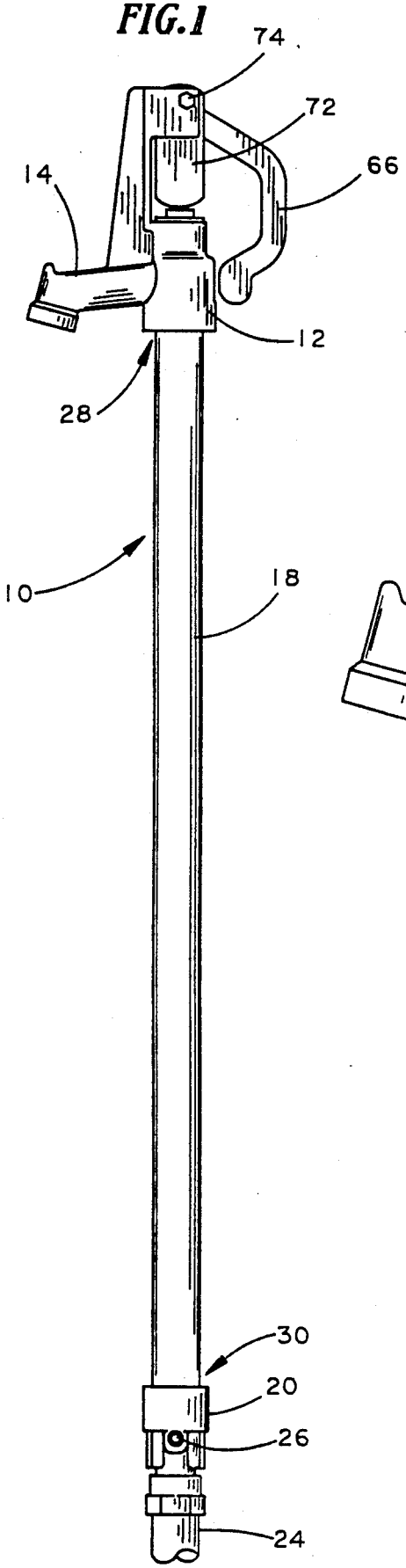
FIG. 1 is an elevational view of a yard hydrant according to this invention.

Referring to the drawings, this new yard hydrant, designated by the numeral 10, has the traditional components of a head section 12 having a discharge nozzle 14 in which is the water channel 16, a standpipe 18 and a valve housing 20 with valve seat 22 adapted for connection to a source of water supply under pressure from pipe 24 in a traditional relationship. A drain hole 26 is providing in housing 20 as is well known.

Components 12, 18 and 20 in the traditional hydrant art are assembled by threadable attachment to each other so they can be disassembled for removal of internal parts that is necessary from time to time for servicing and repairs, and hydrant 10 is an innovative departure from such form of assembly in that components 12, 18 and 20 in hydrant 10 are permanently attached to each other so that they cannot be disassembled. For this purpose, head section 12 and valve housing 20 are provided with smooth bores and standpipe 18 is provided with smooth external surfaces at each end whereby standpipe 18 is permanently attached by a slipfit connection at it upper end 28 to the head section 12 and similarly attached at its lower end 30 to the valve housing 20 by any suitable epoxy for which the trademarked brand COPPER-BOND provides satisfactory results. This form of assembly of components 12, 18 and 20, which so far as known has not been used before, provides a yard hydrant, that compared with other like devices, is more simple, facile and practical together with the important feature of economy in manufacture that will later be referred to in more detail.

Head section 12 has the integral upper body portion 32 in flow communication with channel 12 and said portion is provided with an opening 34 (FIG.3) that is threaded as at 36. An operating rod 38, with a plunger valve 40 on its lower end, is disposed in the standpipe 18 with its upper end extending upwardly through opening 34 in which opening is placed a novel two piece removable packing gland unit 42 (FIGS.2,3) described as follows. One piece of unit 42 is a packing gland 44, shaped as best seen in FIG. 3 to include a top flange edge 46, an internally threaded wall 48, external threads 50, a groove 52 near its bottom to receive an O-ring 54 and a groove 58 near its upper end to receive the O-ring 60, and the other piece is a packing nut 56 externally threaded as at 62 and adapted to receive a suitable packing material 64 in its lower portion in a well known manner. Gland 44, in embracing relationship to rod 38, is threadably secured in opening 34, and the packing nut 56, carrying packing material 64, is journalled on rod 38 and into threadable engagement with the internal threads 48 of gland 44 as best seen in FIG. 2 whereby the placking gland unit 42 provides suitable pressure on material 64 and also serves as a watertight closure for opening 34.

Figure 2:
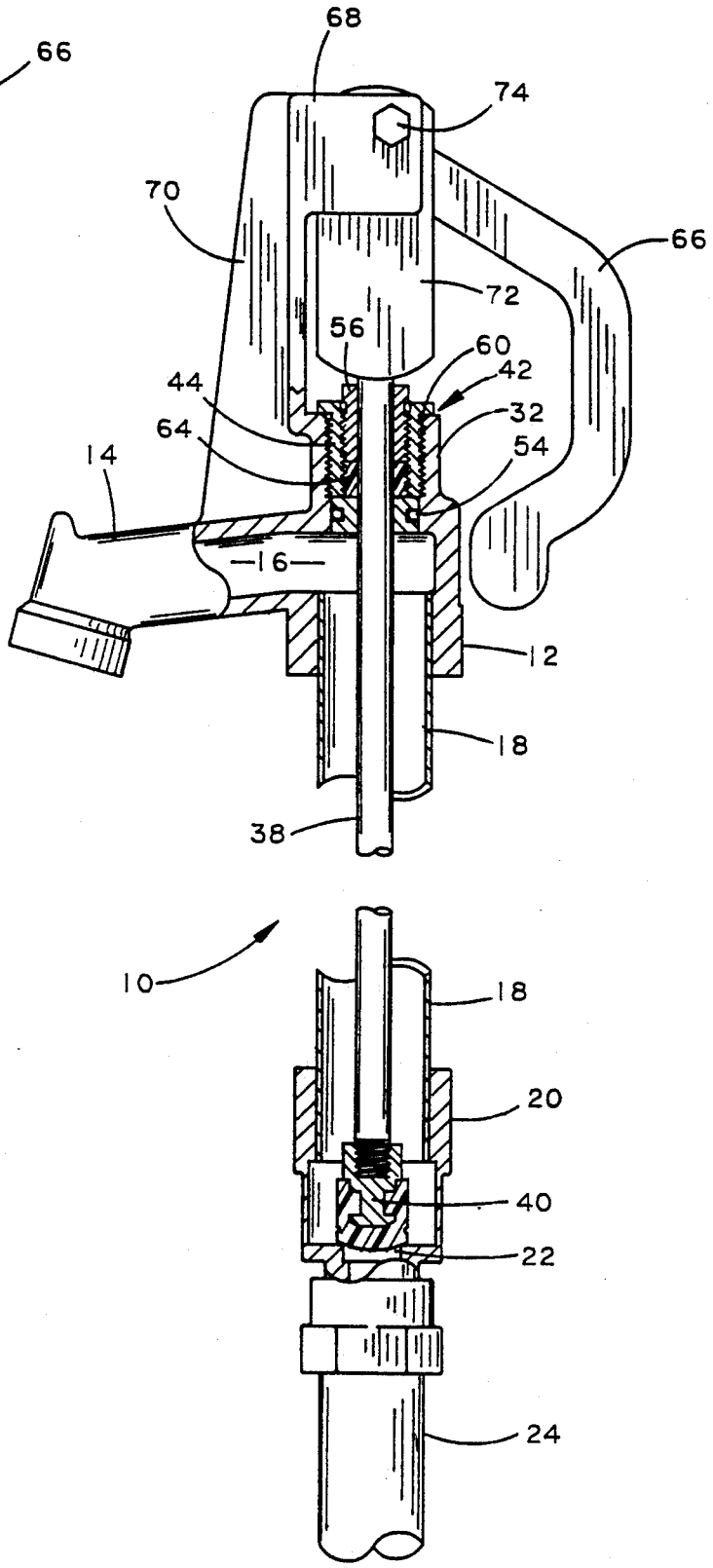
FIG. 2 is an enlarged foreshortened view of the yard hydrant in FIG. 1 with portions broken away to more clearly illustrate the contruction therein.
Figure 3:
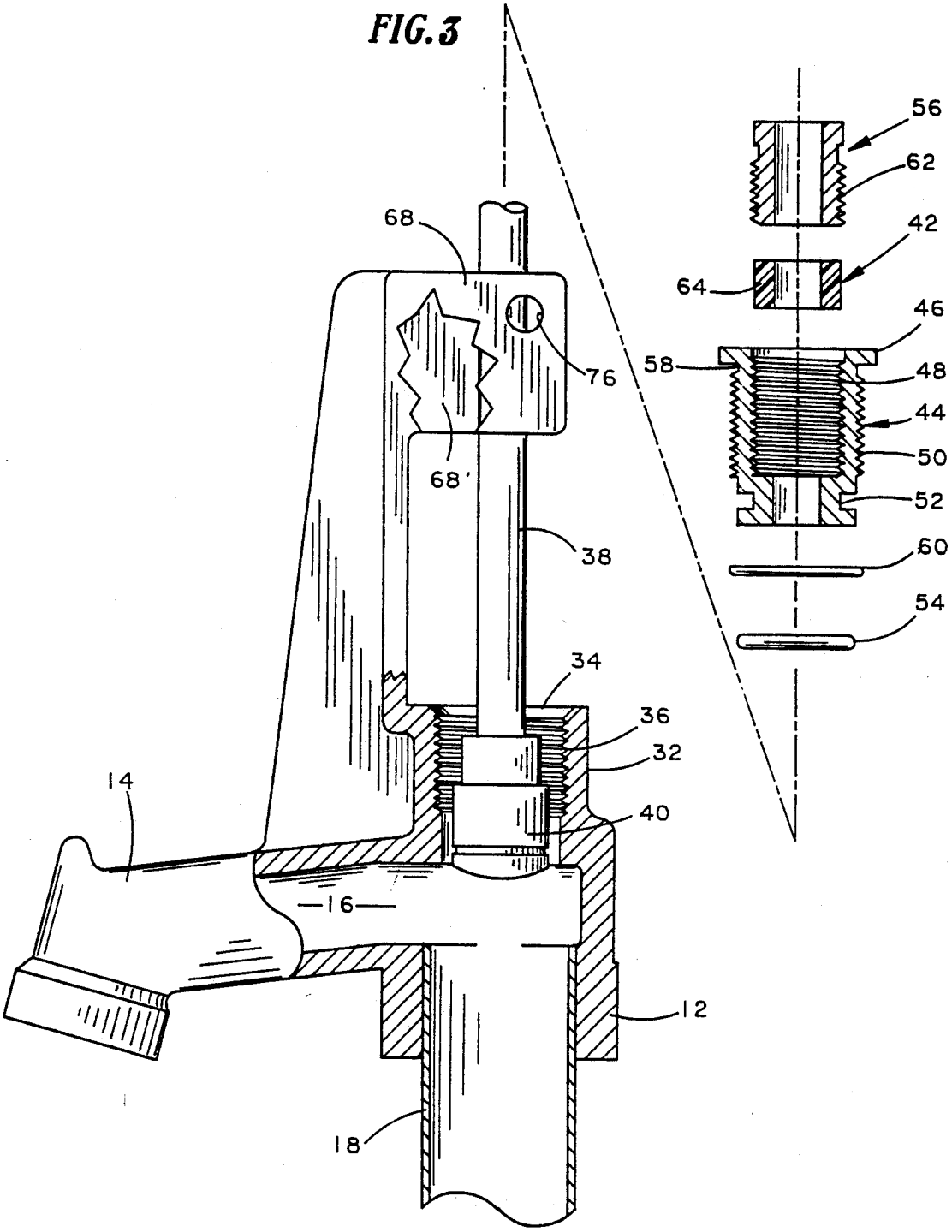
FIG. 3 is an enlarged fragmentary elevational view of the head section showing in exploded adjacent arrangement the novel two piece packing gland unit of this invention removed from the head section and showing the operating rod being withdrawn from such section.

The operating rod 38 is designed to be reciprocated in the standpipe 18 in valve association with the valve housing 20 for water flow control from pipe 24 in a well known manner and for purposes of effecting such reciprocation, I have preferably used a well known form of handle 66 as best seen in FIG. 2. No invention is claimed in such handle. To accommodate handle 66 as shown, I provide a pair of horizontally spaced ears 68, 68' disposed in spaced above relationship to head section portion 32 by an integral head section post 70. A line strap 72 operably connected to the top of the operating rod 38 extends between ears 68, 68' where the top of handle 66 is excentrically secured thereto by a bolt 74 through holes 76 in such ears. By this arrangement, handle 66 can reciprocate rod 38 in a well known manner.

The diameter of opening 34 in head section portion 32 is wider than rod 38 and its attached lower valve plunger component 40 and the significance of the two piece gland unit 44 is that it not only stabilizes rod 38 and secures the packing nut 56, but with handle 66 removed from ears 68, 68', the removal of unit 42 from opening 34 permits the easy and quick removal of rod 38 with valve plunger 40 from the integral unit 10 (FIG.3) for servicing and repairs and the need to dissasemble the head section and standpipe for this purpose as traditionally required is eliminated.

The innovative method of assembling components 12, 18 and 20 into an integral unit 10 that cannot be disassembled provides not only a more practical and facile device that simplifies the removal of internal parts as previously described but has the more important advantage of providing a substantially lower cost alternative in the hydrant art by reducing certain fixed cost factors in assembly that translate into important price reductions for the ultimate consumer.

In yard hydrant construction, the standpipe used to permit the traditional form of assembly and disassembly of components 12, 18 and 20 is generally a five foot long one inch standard wall pipe which actually has an approximate wall thickness of 0.133 inch which I have termed, for purposes here, a thick wall pipe. The necessary threading of both ends of such pipe reduces the wall thickness at the interior of the threads to approximately 0.074 inch to provide what I have called a thin wall pipe. In hydrant 10, which has traditional five foot length of standpipe 18, such standpipe is what I have termed the thin wall pipe with a wall thickness of 0.074 inch although it will be understood that minor variations in such thickness can be made without departing from the scope of this invention. By this arrangement, the use of a thin wall pipe with the slip-fit connection described obtains a cost reduction as compared with the cost of a thick wall pipe plus the costs of the necessary threading for the same and the threading of the head section and valve section, and this has been found to be the case when factoring in the minimal expense of threading unit 42. Under current market prices for hydrant components, it has been found that savings in the use of integral unit 10 as described can be as much as $1.52 per hydrant and while this amount of savings may not seem great in the abstract, it becomes sifnificant in the final selling price in the highly competitive hydrant industry where incremental savings on any component is generally in the range of ten to twenty cents.

The significance of any savings in the manufacturing cost in any industry that manufactures products for sale is that the final selling price includes not only the manufacture's cost but a series of profit markup for others in the channel of distribution such as wholesalers, distributors and retailers so the price to the ultimate customer is thus several times the manufacturer's cost and, as a rule of thumb, it is commonly said for good business practices that the final selling price of a product should be in the range of four to five times the manufacturing cost. Thus, any savings in costs which a manufacturer can obtain will translate into a price reduction of several times such savings for the ultimate purchaser, and in the hydrant industry, a four fold increase in the selling price over the manufacturing cost is not uncommon. Here, with hydrant 10, the savings per hydrant is in the range of six dollars under current cost factors and can be even larger when standpipes longer than the customary five feet may be required or used. It can also be appreciated that even in the fluctuations of prices, higher or lower, the costs of a thin wall pipe will always be less than that for a thick wall pipe due to the obvious material content difference so that the innovative integral unit 10 will have the advantages of economy and utility as described. Accordingly, in view of the foregoing, it is thought a full understanding of the construction and operation of this invention will be had and the advantages of the same will be appreciated.

I claim:

1. A yard hydrant, comprising:

a valve housing with valve means located below ground level for connection to a source of water supply under pressure, a head section with an integral discharge nozzle positioned above ground level, a thin wall standpipe free of any threads and irremovably secured at one end to said valve housing and irremovably secured at the other end of said head section to provide an integral unit that cannot be disassembled, said head section provided with an opening in axial alignment with said standpipe and said valve housing, an operating rod disposed in said standpipe for reciprocation therein so that one end thereof extends upwardly through said opening and the other end thereof extends into said valve housing and has valve means adapted for valve association with said housing for opening and closing water flow therethrough, said opening being concentrically wider than said operating rod and any valve means associated therewith, operating means to reciprocate said operating rod, removable packing means in said opening to stabilize said operating rod and to serve as a sealing closure for said opening, and upon removal of said packing means from said opening said operating rod and said valve means being attached to said packing means for direct removal through said opening solely by reciprocation of said operating rod for servicing means without disassembling said valve housing, said standpipe and said head section.

2. A yard hydrant as defined in claim 1 wherein said removable packing means to stabilize said operating rod and to serve as a closure for said opening includes a packing gland means in pressing engagement with said operating rod.

3. A yard hydrant as defined in claim 1 wherein said removable packing means to stabilize said operating rod and to serve as a closure for said opening includes:

a two piece packing gland unit consisting of:

a packing nut with packing material journalled on said operating rod, and a packing gland in concentric embracing relationship to said packing nut removably mounted in said opening in engagement with said packing nut to urge said packing material into pressing engagement with said operating rod.

4. A yard hydrant as defined in claim 1, including:

said head section and said valve housing provided with smooth wall bores, free of any threads said standpipe having a smooth outer surface at respective ends, and free of any threads said standpipe irremovably secured to said head section and said valve housing by a slip-fit connection.

5. A yard hydrant as defined in claim 4 in which the wall thickness of said standpipe does not exceed 0.074 inch.

6. In a yard hydrant of the class having a head section with nozzle located above ground level and connected to a standpipe that is connected to a valve housing located below ground level that is connected to a source of water supply, an operating rod disposed for reciprocation in said standpipe and valve housing for valve association with said valve housing to open and close water flow therethrough and operating means to reciprocate said operation rod, a new and improved method of assembling said hydrant comprising the steps of:

irremovably attaching a thin wall standpipe free of any threads to said head section and to said valve housing to form an integral unit that cannot be disassembled, providing an opening in said head section concentrically wider than said operating rod and attached components, extending one end of said operating rod through said opening, and providing a removable sealing closure for said opening operably engaging said operating rod and which removing of said closure from said opening with said operating rod being attached thereto permits the direct withdrawal of said operating rod and any attached components from said integral unit through said opening solely by reciprocation of said operating rod without disassembling said valve housing, said standpipe and said head section.

7. A method as defined in claim 6, including the steps of:

providing said head section and said valve housing with smooth wall bores free of any threads providing said standpipe with smooth external surfaces at each end, free of any threads and attaching said standpipe to said head section and said valve housing by a permanent slip-fit connection.

8. A method as defined in claim 7 including using a standpipe on which the wall thickness does not exceed 0.074 inch.

9. A method as defined in claim 6 including providing said closure with packing gland material for operable association with said operating rod.

10. In a yard hydrant, the combination of:

an integral hydrant structure defining a head section having a discharge nozzle located above ground level, a valve housing spaced below said head section and located below ground level, and a thin wall standpipe free of any threads permanently secured to and between said head section and said valve housing, said head section provided with an opening in axial alignment with said standpipe and said valve housing, an operating rod disposed in said standpipe for reciprocation therein so that one end thereof extends upwardly through said opening and the other end thereof extends into said valve housing with said operating rod having valve means adapted for valve association with said housing to open and close water flow therethrough, operating means to reciprocate said operating rod, and removable packing means in said opening to stabilize said operating rod and to serve as a sealing closure for said opening, and upon removal of said packing means from said opening said operating rod and said valve means being attached to said packing means for direct removal through said opening solely by reciprocation of said operating rod for servicing means without disassembling said valve housing, said standpipe and said head section.

11. A yard hydrant as defined in claim 10 wherein said removable packing means to stabilize said operating rod and to serve as a closure for said opening includes a packing gland means in pressing engagement with said operating rod.

12. A yard hydrant as defined in claim 10 wherein said removable packing means to stabilize said operating rod and to serve as a closure for said opening includes:

a two piece packing gland unit consisting of:

a packing nut with packing material journalled on said operating rod, and a packing gland in concentric embracing relationship to said packing nut removably mounted in said opening in engagement with said packing nut to urge said packing material unto pressing engagement with said operating rod.

* * * * *